US006850698B1

(12) United States Patent
Goh

(10) Patent No.: US 6,850,698 B1
(45) Date of Patent: Feb. 1, 2005

(54) HUMIDIFIER FOR USE WITH SOURCE OF HEATED AIR

(76) Inventor: Edward Hua Seng Goh, 3918 Nimit Dr., Bloomington, IN (US) 47401

( * ) Notice: Subject to any disclaimer, the term of this patent is extended or adjusted under 35 U.S.C. 154(b) by 0 days.

(21) Appl. No.: 10/605,299

(22) Filed: Sep. 21, 2003

(51) Int. Cl.[7] ..... A61H 33/12; F24F 6/08
(52) U.S. Cl. ..... 392/403; 392/395
(58) Field of Search ..... 392/386, 387, 392/391, 394, 395, 402, 403, 40 R, 406; 454/328; 261/139, 142, 99, DIG. 6 R; 239/34, 35, 44, 4 R

(56) References Cited

U.S. PATENT DOCUMENTS 3,757,494 A * 9/1973 Keuls ..... 96/263
4,237,080 A * 12/1980 Elliott ..... 261/80
4,738,805 A * 4/1988 Lawson ..... 261/24
5,693,266 A * 12/1997 Jung ..... 261/142

* cited by examiner

*Primary Examiner*—Sang Paik
(74) *Attorney, Agent, or Firm*—Richard D. Fuerle

(57) ABSTRACT

A free-standing humidifier is suitable for placement near a source of heated air, which supplies the moving air that is humidified. The humidifier has a main reservoir for holding water, a rod having a length sufficient to extend across the reservoir, and panels that support the rod. The rod is held horizontally in a position higher than the reservoir and displaced horizontally away from the reservoir. A disposable paper towel is draped over the rod and one end of the paper towel is inserted through an opening in the top of the reservoir into water in the reservoir. Air flowing from the source impinges upon the paper towel and picks up moisture from it. A supplemental reservoir can be used to automatically supply additional water to the main reservoir from a water line that has a valve controlled by a float which turns the valve on and off.

18 Claims, 4 Drawing Sheets

HUMIDIFIER FOR USE WITH SOURCE OF HEATED AIR

CROSS REFERENCE TO RELATED APPLICATIONS

This application claims priority from Disclosure Document No. 533917, filed Jun. 26, 2003, titled "A New Room Humidifier With a Disposable Paper Towel Wick."

BACKGROUND OF INVENTION

This invention relates to a humidifier that uses a disposable paper towel wick and the air from an air source in the floor or wall. In particular, it relates to a humidifier having a water reservoir, a paper towel wick, and a rod to hold the wick.

Currently available wicking room humidifiers use expensive, custom-made wicks that are often difficult to obtain. The wicks must also be replaced frequently because they become saturated with minerals in the water which deposit out on the wick, rendering it much less effective. Bacteria and mold growing on the wick can also be a concern. Manufacturers recommend changing the wick every 3 or 4 months.

Most humidifiers have an internal source of heat and a motorized fan that blows air over the heat source and through or against the wick. The use of an internal heat source and a fan adds substantially to the cost, size, and weight of the humidifier, and these parts eventually wear out and must be repaired or replaced.

U.S. Pat. No. 5,324,230 discloses a small, portable humidifier for use when travelling. The humidifier can be use only with an air register that is on a wall. The use of a wall register eliminates the need for an internal source and a fan. The reservoir for the humidifier is cylindrical and holds only a small volume of water. A fabric is used as the wick. The humidifier is attached to the wall register by a magnet or hooks. Since wall registers come in many different sizes and shapes and are located in a variety of positions, it may not always be possible to attach the humidifier to a particular air register.

SUMMARY OF INVENTION

In the humidifier of this invention, the use of costly, custom-made wicks is avoided by using one or more disposable paper towels, which are inexpensive and available in every home. The humidifier is placed over or near a source of heated air, which supplies the warm, moving air needed to evaporate water from the paper towel, thereby eliminating an internal heat source and fan.

The paper towels can be quickly, easily, and frequently changed without worrying about the cost or the supply. Since almost all of the evaporation is from the paper towel rather than from the reservoir, the reservoir remains free of mineral deposits and requires only occasional cleaning.

The humidifier does not have any moving parts to wear out and can operate for many years solely on tap water and disposable paper towels. It is non-electric and is safe for children and pets. It is self-regulating and does not cause over-humidification or condensation. A single humidifier placed over a floor register in a home can evaporate as much as 1.2 quarts of water a day and can increase the relative humidity of a well-insulated average-sized room by 20% or more. It can be used with either a floor air vent, a wall air vent, a radiator, a convector, or a baseboard heater.

DETAILED DESCRIPTION

Figure 1:
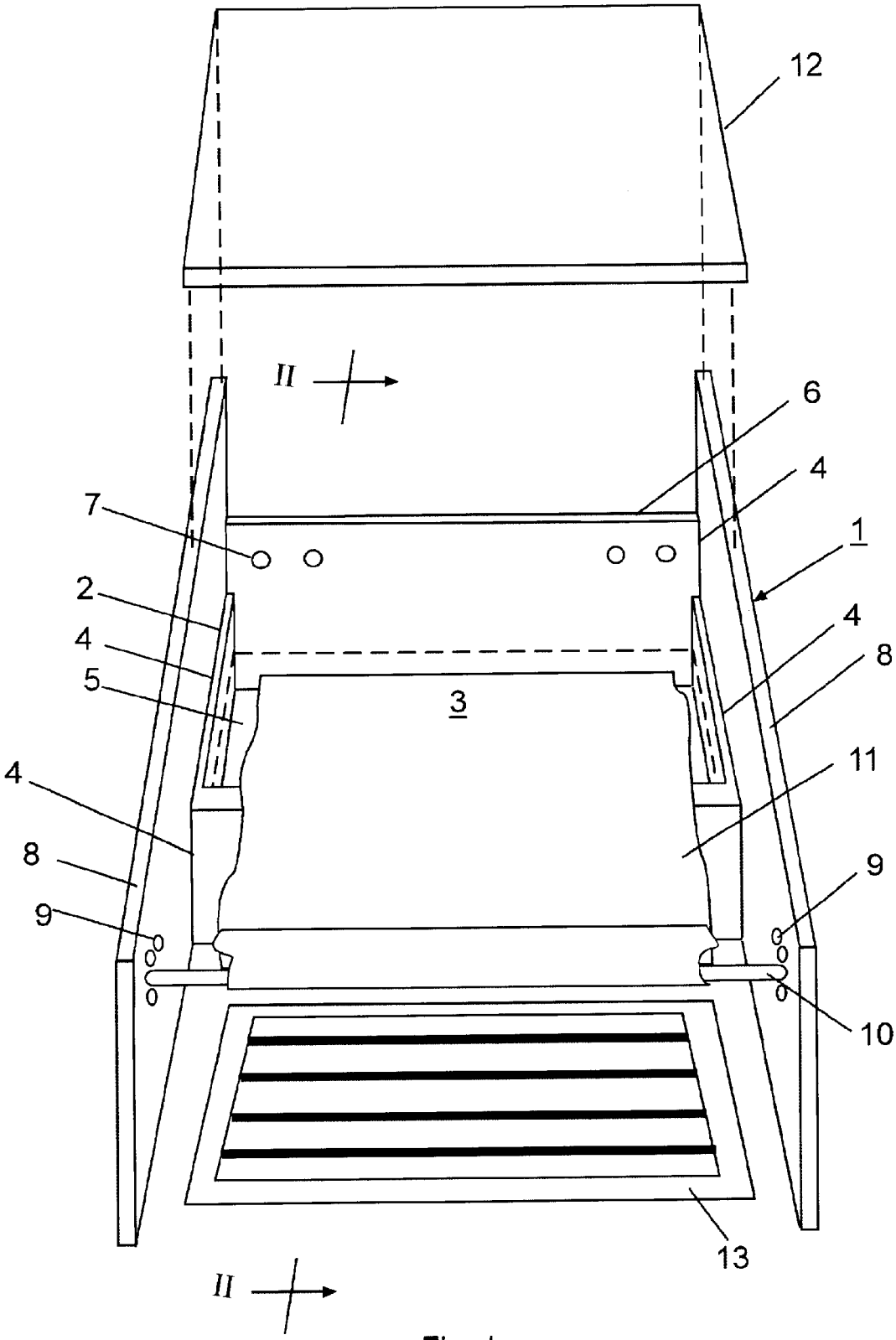
FIG. 1 is an isometric view of a certain presently preferred embodiment of a humidifier according to this invention.
Figure 2:
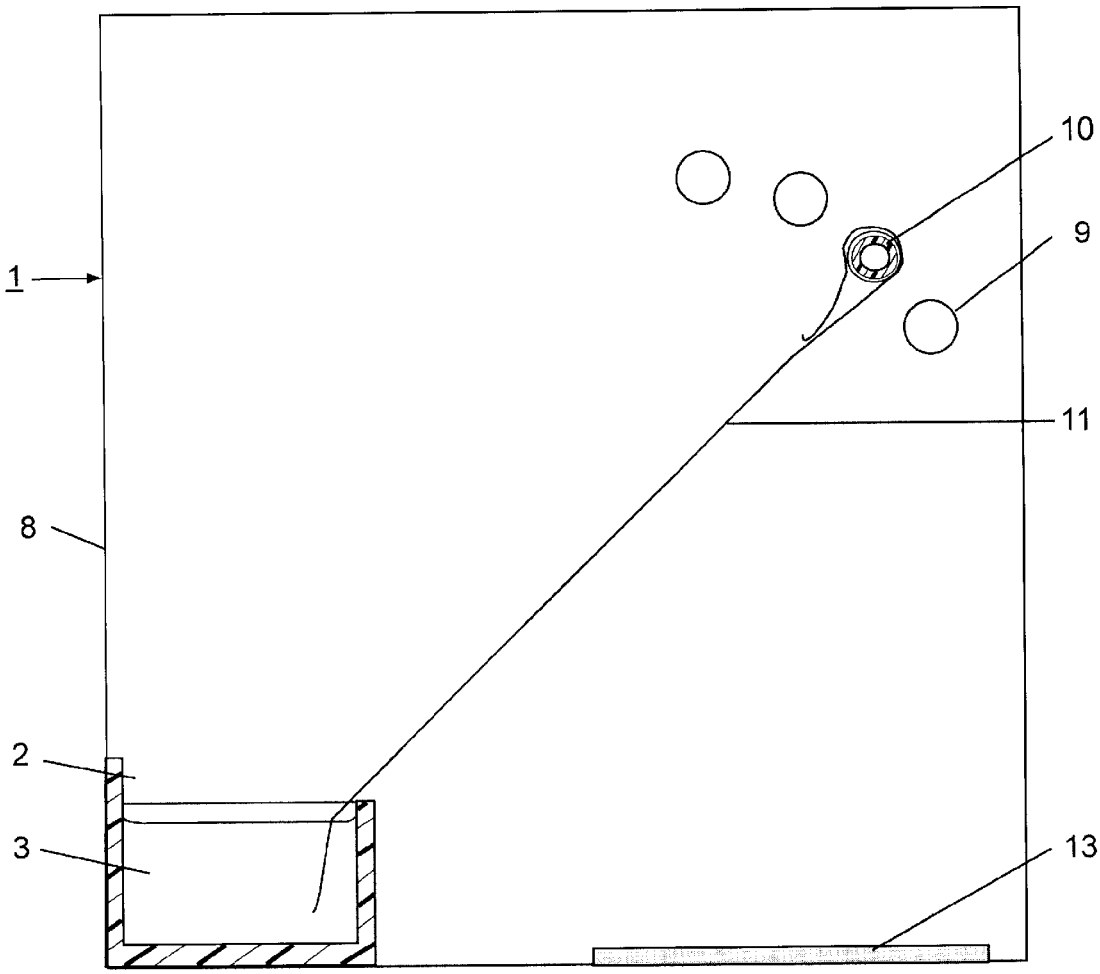
FIG. 2 is an side view through II—II in FIG. 1.

In FIGS. 1 and 2, humidifier 1 has a reservoir 2 for holding water 3. Reservoir 2 is shown as a rectilinear waterproof container having four walls 4 and a bottom 5, though other shapes can also be used. Reservoir 2 preferably holds about ¼ to about ½ gallon of water, though larger or smaller reservoirs could also be used. Preferred dimensions for reservoir 2 for use in a home are about 11 to about 12 inches wide, about 3 to about 4 inches long, and about 3 to about 4 inches high. These dimensions are compatible with the size of most home hot air vents and will hold sufficient water to last for several days under typical winter heating conditions.

Back wall 6 of reservoir 2 is higher than the other sides to provide support for eyelets 7. Screws can be inserted into eyelets 7 to fasten humidifier 1 to a wall when necessary, as hereinafter explained.

To the side walls of reservoir 2 are attached panels 8, which extend about 5 to about 8 inches above the height of reservoir 2 and extend in a horizontal direction about 5 to about 8 inches beyond reservoir 2. Panels 8 can be attached to reservoir 2 by any suitable means, such as adhesive, snaps, screw, bolts, or flaps that extend into reservoir 2, but they are preferably removeably attached so that the entire humidifier can be placed in a small package for shipment and storage. Each panel 8 is provided with several (e.g., 2 to 5) opposing apertures 9 into which can be inserted rod 10. In addition to holding rod 10, panels 8 also direct the flow of heated air to paper towel 11, thereby increasing the efficiency of the humidifier.

Apertures 9 are positioned close enough to reservoir 2 so that one end of a paper towel 11 can be draped over rod 10 while the other end can be draped over the front side of reservoir 2 and immersed in water 3 in reservoir 2. Rod 10 preferably has a diameter of about ¼ to about ½ inches. Apertures 9 enable rod 10 to be held in several different positions, so that paper towel 11 can be placed at more than one angle to the floor. Angles of about 30 to about 60 degrees to the floor are preferred. Preferably, paper towel 11 should be at an angle to the air flow to maximize evaporation of the water from the paper towel. Sheets of paper towel for use with the humidifier preferably are disposable and about 11 to about 13 inches long and about 11 to about 13 inches wide, but towels having other dimensions can also be used and more than one paper towel can be overlapped or used side-by-side.

An optional cover 12 is provided to fit over reservoir 2 and rest on panels 8. It is placed on the back half of the top of reservoir 2. Cover 12 prevents objects from falling into reservoir 2 and improves the appearance of humidifier 1, but leaves an opening into reservoir 2 for paper towel 1. Cover 12 can also be used with a wall register if it is necessary to channel the air to paper towel 11.

To use humidifier 1, it is assembled as shown in FIG. 1 and is positioned over a hot air vent 13. The air vent is preferably in the floor, as shown in FIG. 1, but it could also be in the lower portion of a wall. Reservoir 2 is filled with water 3 and rod 10 is inserted through opposing apertures 9, using those apertures that will best position paper towel 11 in the air stream coming from air vent 13. One end of paper towel 11 is draped over rod 10 while the other end is inserted into water 3. Paper towel 11 is preferably draped from the bottom to the top of rod 10, as shown in the drawings, to prevent moving air from a register from blowing the paper towel off rod 10. Water 3 will wick up paper towel 11 so that the entire paper towel is moist. When the furnace goes on and hot air is emitted from hot air vent 13, the hot air blows against paper towel 11, evaporating water from it and increasing the humidity of the air. As water evaporates, additional water wicks up paper towel 11 and salts dissolved in the water (e.g., carbonates and sulfates) precipitate onto paper towel 11, which can be periodically discarded and replaced as needed.

The humidifier can be placed between the nearest wall and the floor register if there is sufficient room. If not, the floor register would be between the humidifier and the wall.

The humidifier can also be placed over a radiator, a convector, or a baseboard heater so that warm air emanating therefrom impinges upon the paper towel. The humidifier can rest on the radiator, convector, or baseboard heater and/or it can be attached to a wall by means of screws through eyelets 7 or it can be placed on a shelf.

Figure 3:
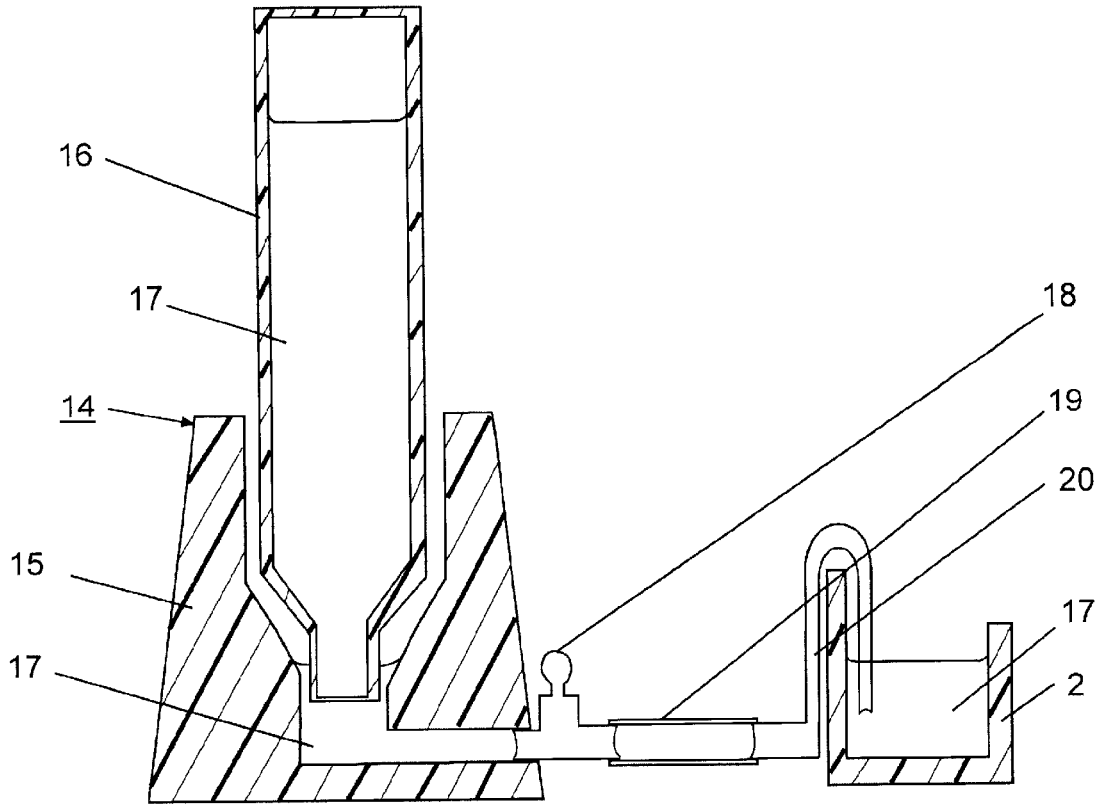
FIG. 3 is a side view, partially in section, showing a supplemental reservoir that can be used with the humidifier shown in FIG. 1.

FIG. 3 shows a supplemental reservoir 14 that can be used with the humidifier of FIGS. 1 and 2 in order to increase the time in between refilling. A base 15 supports a two liter bottle 16 that has been filled with water 17. Water 17 runs through valve 18 and tubes 19 and 20 into reservoir 2. Valve 18 can be turned off whenever bottle 16 is removed and refilled. To use supplemental reservoir 14, water is poured into base 15 and bottle 16 is filled with water, inverted while holding a thumb over the end, then inserted into base 15.

Figure 4:
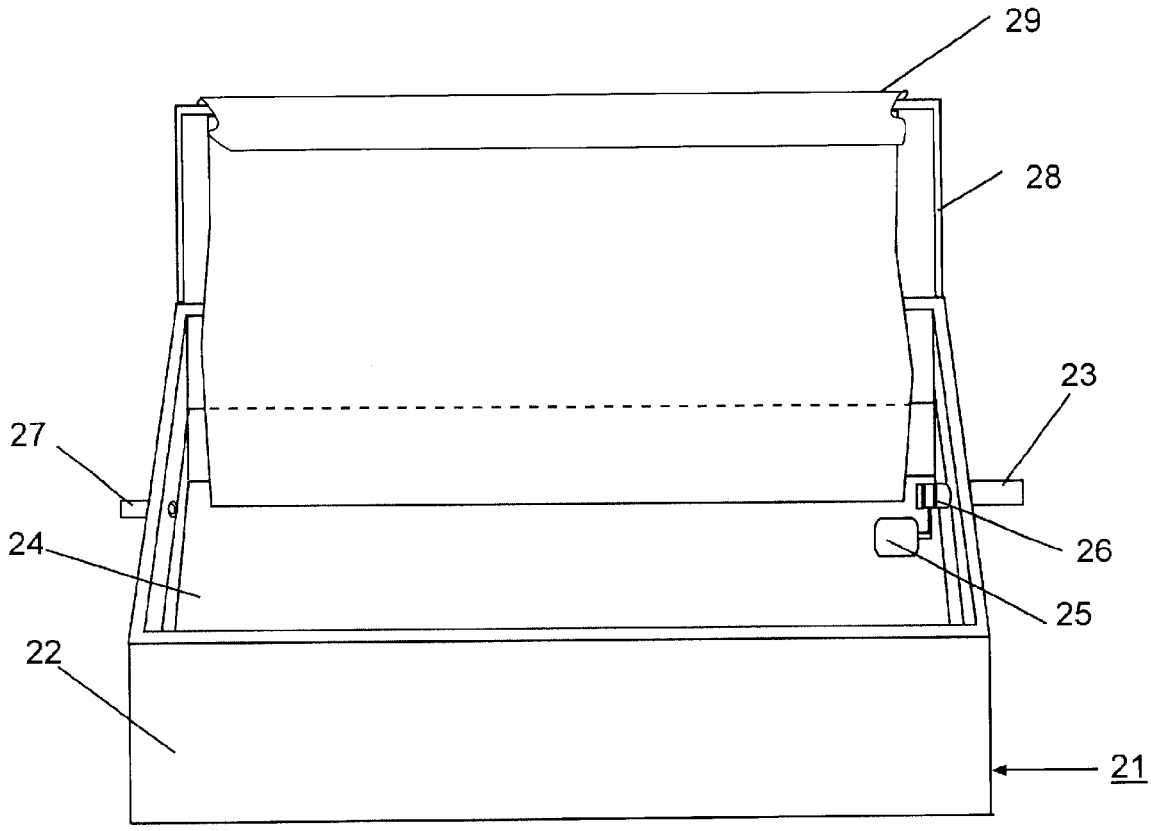
FIG. 4 is an isometric view of an alternative certain presently preferred embodiment of a humidifier according to this invention.

In FIGS. 4, a larger humidifier 21 is shown. Reservoir 22 has a water inlet 23 through which water 24 enters reservoir 22. Float 25, attached to valve 26, permits water to flow through inlet 23 whenever the level of water 24 in reservoir 22 is low. Excess water in reservoir 22 leaves reservoir 22 through outlet 27. One or more frames 28 are provided that can be attached to reservoir 22. Frames 28 support a number of paper towels 29 (e.g., four to six), one end of which immersed in water 24 in reservoir 22. Humidifier 21 is placed so that hot air impinges upon paper towel 29, whereby the air picks up moisture from the paper towels. Humidifier 21 can be used for commercially-sized floor or wall registers, convectors, radiators, and baseboard heaters.

The humidifier can be made of a variety of materials, including metals and glass, but it is preferably made of plastic as that material is inexpensive, waterproof, and can be easily formed. The preferred plastic is a heat resistant plastic, such as polystyrene or polypropylene.

The following example further illustrates this invention.

EXAMPLE

From an acrylic sheet 24"×24"×⅛" was cut two 11"×12" side panels, one 4"×11½" reservoir bottom, one 3⅛"×11½" reservoir front, one 3⅝"×11½" reservoir back with four evenly spaced screw holes ½ " from the top, and two 4⅛"×3¼" reservoir ends.

The pieces for forming the reservoir were assembled as shown in FIG. 1 by clamping them together at right angles then gluing them at the edges with methylene chloride. After drying for 30 minutes, the reservoir was tested for leaks.

The side panels were clamped together and lines 4" from the bottom (11¾") and 3" from the right side (10¾") of the panels were drawn to represent the position of the front corner of the reservoir. An 8" arc was drawn from this corner. Lines at 30, 40, 50, and 60 degrees from the horizon were drawn from the corner to intercept the arc and ¼ " holes were drilled where the lines intercepted the arc. The holes were smoothed by scraping. The panels were unclamped and glued to the short ends of the reservoir with methylene chloride.

The rod for the paper towel was made from a plastic coat hanger. The hanger was cut to a 12" length and the rod was sanded down to a diameter of ¼" at both ends. The ends were inserted into the holes in the side panels to support the paper towel. The humidifier was placed between a wall and a floor register to humidify heated air entering the room from the register.

Although a preferred embodiment of the portable room humidifier of the present invention has been described herein and fully illustrated by the drawing figures, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A humidifier suitable for placement near a source of heated air comprising (A) a reservoir for holding water, said reservoir having an opening on top;

(B) a rod having a length sufficient to extend across said reservoir; and (C) two opposing panels that attach to said reservoir and have a multiplicity of opposing apertures through said panels into which said rod can be inserted horizontally in a position higher than said reservoir and displaced horizontally away from said reservoir, where one end of at least one paper towel can be draped over said rod and the other end of said at least one paper towel can be inserted through said opening into water in said reservoir, whereby air flowing from said source impinges upon said at least one paper towel.

2. A humidifier according to claim 1 wherein said reservoir is made of plastic.

3. A humidifier according to claim 1 wherein said reservoir is rectilinear.

4. A humidifier according to claim 3 wherein said rectilinear reservoir is about 3 to about 4 inches deep, about 11 to about 12 inches wide, and about 3 to about 4 inches high.

5. A humidifier suitable for placement near a source of heated air comprising (A) a reservoir for holding water, said reservoir having an opening on top;

(B) a rod having a length sufficient to extend across said reservoir; and (C) two opposing panels about 11 to about 12 inches long and about 11 to about 12 inches high that attach to said reservoir and have opposing apertures therethrough into which said rod can be inserted attached to said reservoir for holding said rod horizontally in a position higher than said reservoir and displaced horizontally away from said reservoir, where one end of at least one paper towel can be draped over said rod and the other end of said at least one paper towel can be inserted through said opening into water in said reservoir, whereby air flowing from said source impinges upon said at least one paper towel.

6. A humidifier according to claim 1 wherein said air source is a radiator, a convector, or a baseboard heater over which said humidifier is positioned.

7. A humidifier according to claim 1 wherein said reservoir holds about ¼ to about ½ gallon of water.

8. A humidifier according to claim 1 including a disposable paper towel that is at about 11 wide and about 13 inches long.

9. A humidifier according to claim 1 wherein said source is a register in a floor and said rod is positioned so that said paper towel is at an angle to the floor.

10. A humidifier according to claim 1 including a cover that is supported by said reservoir.

11. A humidifier according to claim 1 wherein only a single paper towel is draped over said rod and inserted into said water.

12. A humidifier according to claim 1 wherein multiple paper towels can be draped over said rod and inserted into said water.

13. A humidifier according to claim 1 including a supplemental water source that automatically supplies water to said reservoir whenever the level of water in said reservoir is low.

14. A humidifier according to claim 13 wherein said supplemental water source comprises an inverted bottle containing water that is connected by a tube to said reservoir.

15. A method of humidifying air comprising placing a humidifier according to claim 1 near a source of heated air, whereby air from said source impinges upon a paper towel draped over said rod.

16. A free-standing humidifier for use with an air register in a floor comprising (A) a rectilinear reservoir for holding water, where said reservoir has an opening on top and can be placed next to said air register on said floor;

(B) panels that attach to each side of said reservoir and extend about 5 to about 8 inches higher than said reservoir and extend horizontally about 5 to about 8 inches beyond said reservoir;

(C) at least two opposing apertures through said panels that are higher than said reservoir and are over said air register;

(D) a rod inserted though said opposing apertures, whereby one end of a single paper towel is inserted into water held in said reservoir and the other end of said single paper towel is held by said rod; and (E) a flat cover that rests on said reservoir.

17. A free-standing humidifier according to claim 16 wherein a supplemental water source automatically supplies water to said reservoir whenever the level of water in said reservoir is low.

18. A free-standing humidifier according to claim 16 including (A) a water inlet that provides a continuous source of water to said reservoir;

(B) a valve on said water inlet that is controlled by a float on water in said reservoir, where said valve opens when the level of water in said reservoir falls and closes when the level of water in said reservoir rises; and (C) means attached to said reservoir for holding one end of at least one paper towel in a position that is higher than said reservoir and is displaced in a horizontal direction from said reservoir.

* * * * *